US011389693B2

(12) United States Patent
Kim

(10) Patent No.: US 11,389,693 B2
(45) Date of Patent: Jul. 19, 2022

(54) BICYCLE EXERCISE APPARATUS

(71) Applicant: Dong Soo Kim, Osan-si (KR)

(72) Inventor: Dong Soo Kim, Osan-si (KR)

( * ) Notice: Subject to any disclaimer, the term of this patent is extended or adjusted under 35 U.S.C. 154(b) by 0 days.

(21) Appl. No.: 17/164,876

(22) Filed: Feb. 2, 2021

(65) Prior Publication Data

US 2021/0275862 A1 Sep. 9, 2021

(30) Foreign Application Priority Data

Mar. 3, 2020 (KR) ..... 10-2020-0026856

(51) Int. Cl.
*A63B 22/06* (2006.01)
*A63B 71/00* (2006.01)

(52) U.S. Cl.
CPC ..... *A63B 22/0605* (2013.01); *A63B 71/0054* (2013.01); *A63B 2022/0641* (2013.01)

(58) Field of Classification Search
CPC ..... A63B 22/0605; A63B 71/0054; A63B 2022/0641; A63B 22/18; A63B 21/023; A63B 21/04; A63B 23/0476; A63B 2022/0635; A63B 21/0428; A63B 21/05
See application file for complete search history.

(56) References Cited

U.S. PATENT DOCUMENTS 2,903,262 A * 9/1959 Stukenborg ..... A63G 13/08 472/105
5,496,237 A * 3/1996 Hensley ..... A63G 13/08 472/105
10,039,954 B1 * 8/2018 Tung ..... A63B 22/0605
2007/0184940 A1 * 8/2007 Tomes ..... A63B 69/0093 482/121
2020/0054919 A1 * 2/2020 Karabush ..... A63B 21/0428
2020/0061409 A1 * 2/2020 Lin ..... A63B 21/225

FOREIGN PATENT DOCUMENTS

KR 10-1998-0042970 A 8/1998
KR 20-0248808 Y1 10/2001
KR 20-0277783 Y1 6/2002
KR 10-2014-0038744 A 3/2014
KR 10-1564677 B1 10/2015
KR 20170052292 A * 11/2015 ..... A63B 22/00

* cited by examiner

*Primary Examiner* — Andrew S Lo
*Assistant Examiner* — Andrew M Kobylarz
(74) *Attorney, Agent, or Firm* — KORUS Patent, LLC; Seong Il Jeong

(57) ABSTRACT

A bicycle exercise apparatus is disclosed. The bicycle exercise apparatus comprises a frame body installed to be supported by a floor of an installation site and having an exercise space in a center thereof, a plurality of spring members each having one end that is installed on the frame body and the other end that is extended to the exercise space, and an exercise saddle installed in such a way that a lateral side thereof is connected to the other end of the spring member, to be able to be moved by an elastic force of the spring member.

3 Claims, 7 Drawing Sheets

BICYCLE EXERCISE APPARATUS

FIELD OF THE INVENTION

The present invention relates to a bicycle exercise apparatus that enables a user to do bicycle exercise in a state that a saddle is supported by an elastic force of springs.

BACKGROUND OF THE INVENTION

The benefits of cycling are strengthening a lower body and improving flexibility of a waist and an upper body. In order to achieve these benefits, exercise bikes for indoor use, which have no wheel and have certain resistance on pedals, are widely used.

In general, an exercise bike benefits on thighs and calves as a user pedals; in addition, as a user steps on both pedal alternatively, hips and a waist move from side to side, which lead to additional workout effects and weight loss.

The exercise bike consists of a saddle that a user sits on to exercise, a bicycle body connected to a bottom portion of the saddle through a saddle pipe, a base frame fixed to the bottom side of the bicycle body and supporting the bicycle body, a handle pipe attached to an upper portion of one side of the bicycle body with a certain angle, a handlebar fixed to the upper side of the handle pipe, and a pair of pedals installed on the sides in the center of the bicycle body.

Using the exercise bike consisted of the elements above, a user exercises by sitting on the saddle, putting his or her foot on the pedals, and spinning the pedals with his or her legs.

However, as a user only pedals sitting in the saddle, there is a limit to exercise of the whole body.

The related prior may be Korean Patent Registration No. 10-1564677.

SUMMARY OF THE INVENTION

One embodiment of the inventive concept provides a frame body installed to be supported by a floor of an installation site and having an exercise space in a center thereof; a plurality of spring members each having one end that is installed on the frame body and the other end that is extended to the exercise space, and an exercise saddle installed in such a way that a lateral side thereof is connected to the other end of the spring member, to be able to be moved by an elastic force of the spring member.

The frame body may comprise a bottom frame supported by the floor, and a plurality of support frames protruded from the bottom frame and connected to the spring members.

The bicycle exercise apparatus may further comprise a guard member that is installed between the support frames to protect a user.

The bicycle exercise apparatus may further comprise a post rid, wherein the post rid may be protruded from the bottom frame between the support frames and be connected to the exercise saddle through an elastic connecting part.

The elastic connecting part may be a spring member connecting between the post rod and the exercise saddle.

The bicycle exercise apparatus may further comprise a support spring that is installed inside the post rod, wherein the post rod comprises an opening that has a shape of a long hole at a lateral side and exposes the support spring.

One end of the elastic connecting part may be connected to the exercise saddle, and the other end of the elastic connecting part may be a connecting rod which is connected to the support spring through the opening.

One embodiment of the inventive concept provides a bicycle exercise apparatus that enables a user, in a state of siting on a saddle which is installed to be connected to a frame through springs, to benefit from pedaling exercise and additional exercise by an elastic force of spring.

According to one embodiment of the inventive concept, the saddle can be installed to be moved by an elastic force of the spring members when a user pedals in a state of siting on the saddle. Thus, the user can obtain additional exercise effect according to movements of the saddle by an elastic force of the springs, which can improve user satisfaction.

DETAILED DESCRIPTION EMBODIMENTS OF THE INVENTIONS

Hereafter, the embodiments of the present invention will be described in detail with reference to the accompanying drawings so that an ordinary person skilled in the art can properly understand it. However, the present invention can be embodied to various forms and is not limited to embodiments described here.

In accompanying drawings, some parts, which are not related to explanation of the present invention, have been omitted for clarity. Components are rendered the same reference number that are the same or are in correspondence throughout the specification.

Figure 1:
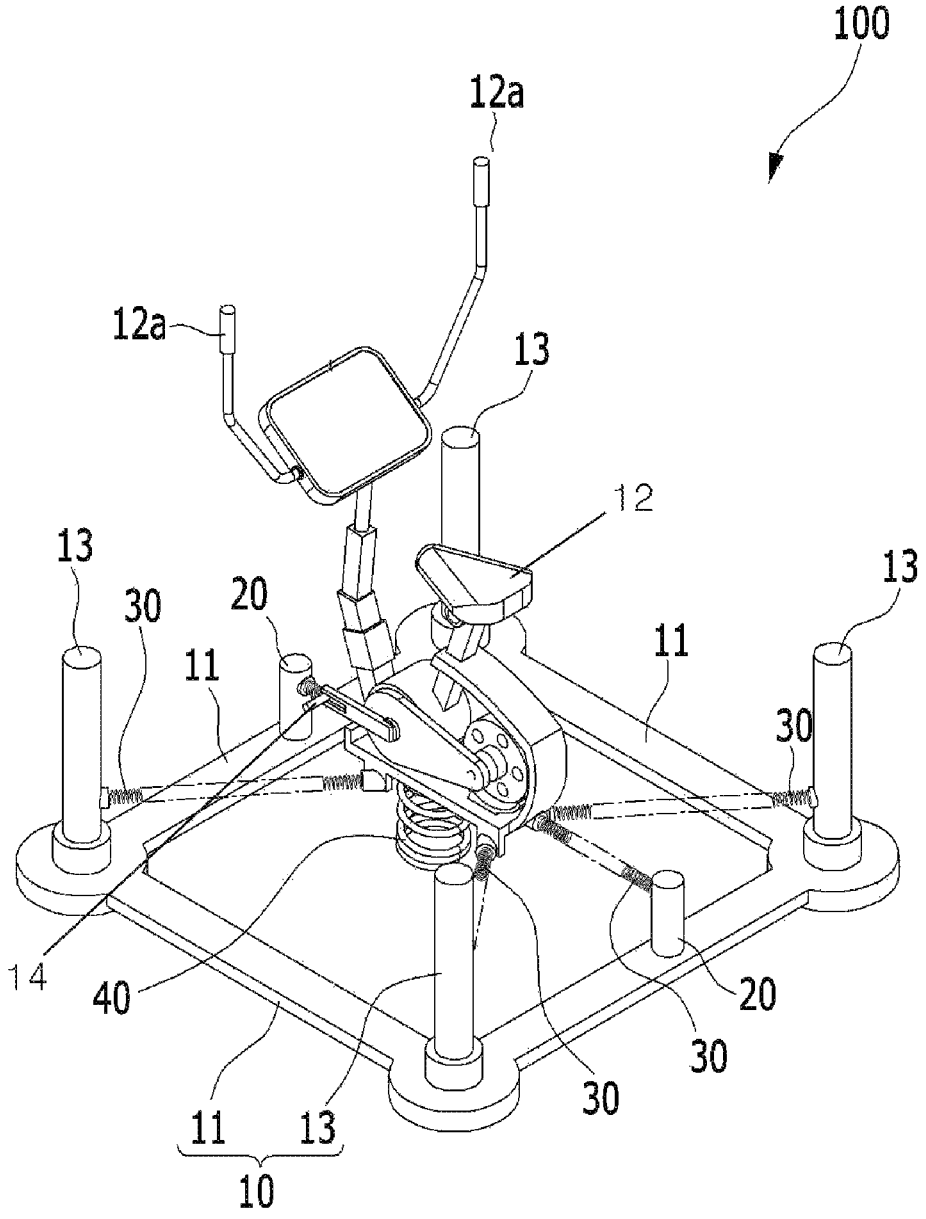
FIG. 1 schematically illustrates a perspective view of a bicycle exercise apparatus according to a first embodiment of the present invention.
Figure 2:
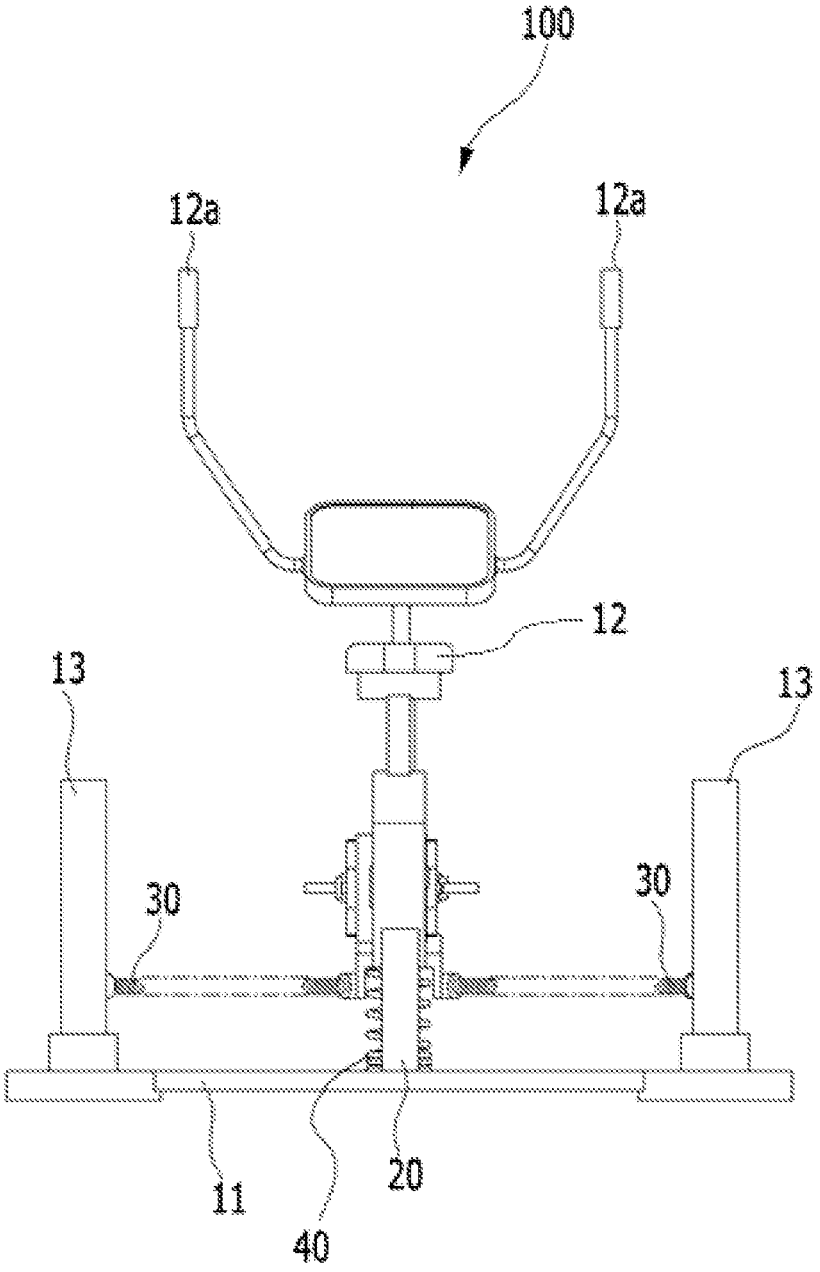
FIG. 2 schematically illustrates a front view of the bicycle exercise apparatus of FIG. 1.
Figure 3:
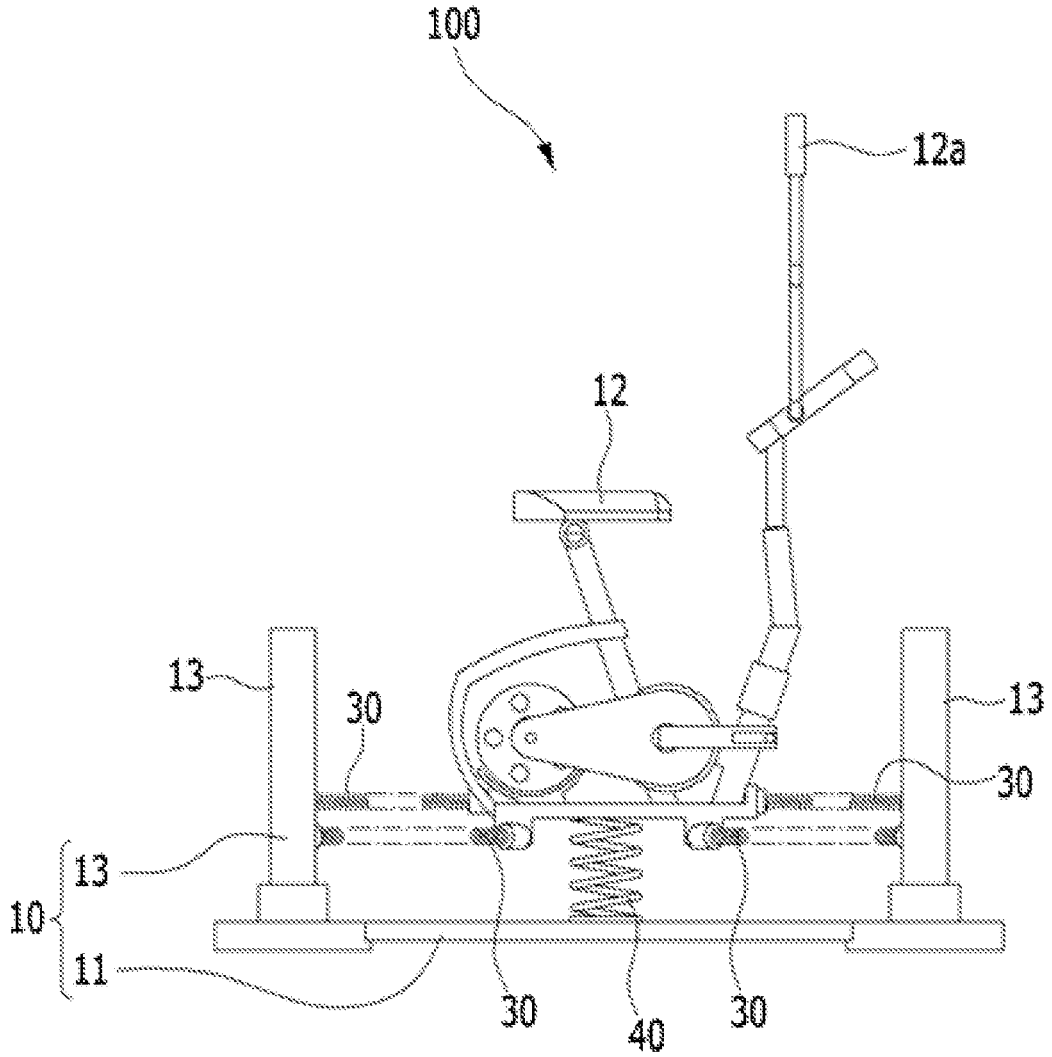
FIG. 3 schematically illustrates a side view of the bicycle exercise apparatus of FIG. 1.
Figure 4:
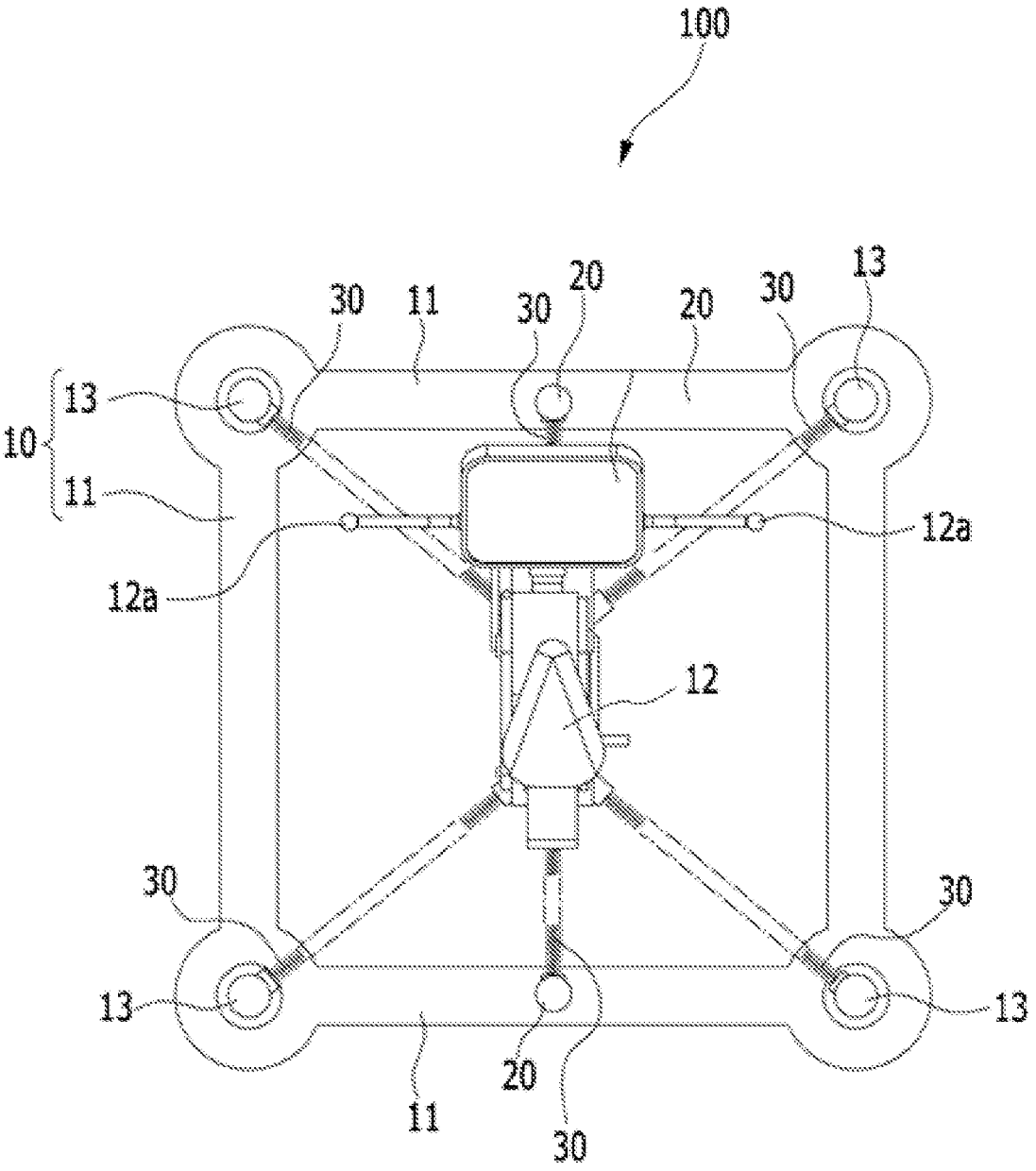
FIG. 4 schematically illustrates a top view of the bicycle exercise apparatus of FIG. 1.

FIG. 1 schematically illustrates a perspective view of a bicycle exercise apparatus according to a first embodiment of the present invention. FIG. 2 schematically illustrates a front view of the bicycle exercise apparatus of FIG. 1. FIG. 3 schematically illustrates a side view of the bicycle exercise apparatus of FIG. 1. FIG. 4 schematically illustrates a top view of the bicycle exercise apparatus of FIG. 1.

Referring to FIGS. 1 to 4, a bicycle exercise apparatus 100 according to a first embodiment of the present invention comprises a frame body 10 installed to be supported by a floor of an installation site and having an exercise space in a center thereof, a plurality of spring members 30 each having one end that is installed on the frame body 10 and the other end that is extended to the exercise space, and an exercise saddle 12 installed that a lateral side thereof is connected to the other end of the spring member 30, to be able to be moved by an elastic force of the spring member 30.

The frame body 10 may be installed to be supported by a floor of an installation site and having an exercise space in a center of the frame body 10.

More specifically, the frame body 10 may comprise a bottom frame 11 which is supported by the floor, and a plurality of support frames 13 which are protruded from the bottom frame 11 and are connected to the spring members 30.

The bottom frame 11 may be installed to be secure against movements, from top to bottom and from left to right, of the exercise saddle in the floor of the installation site.

Thus, the bottom frame 11 may be installed in a way that a plurality of frames are stably connected to each other by welding, or other methods, in the floor of the installation site and can support weights of the exercise saddle that a user sits.

The bottom frame 11 is described to be installed to have a square shape by connecting four frames, but the present invention is not limited to this example. The bottom frame 11 may be adjusted to have a polygon shape by connecting more than four frames.

The support frames 13 may be installed to protrude upward from the bottom frame 11.

The plurality of support frames 13 may be installed to protrude at angular points of the bottom frame 11, respectively, and may be made of metal material to stably support weights of the exercise saddle when a user sits.

A post rod 20 may be installed to protrude from the bottom frame 11 between the plurality of support frames 13. Installation of the post rod 20 is in order to connect the post rod 20 with an elastic connection part, which is embodied to a spring member 30, in the front and the rear of the exercise saddle 12.

Meanwhile, the spring member 30 may be installed on the support frame 13.

One end of the spring members 30 may be installed on the support frame 13 of the frame body and the other end is extended to the exercise space.

The spring member 30 may be installed to be extended toward a center of the exercise space, and the spring member 30 may be plural in order to lateral sides of the exercise saddle 12.

Thus, one end of the spring member 30 is connected to the support frame 13, and the other end is connected to the lateral side of the exercise saddle 12. The plurality of spring members 30 may radially connect between the exercise saddle 12 and the plurality of support frames 13.

In this embodiment, the four of the spring members 30 are described to radially connect between the exercise saddle 12 and the plurality of support frames 13, but the present invention is not limited to this example. The number of spring members 30 may be more than four to stably support weights of the exercise saddle 12.

Meanwhile, the exercise saddle 12 may be installed to be supported by an elastic force of spring members 30 so that the exercise saddle 12 can be moved freely in a horizontal direction and a vertical direction by weights or movements of a user when the user sits on the exercise saddle 12.

The exercise saddle 12 may be installed in a way that a user sitting on the exercise saddle 12 and holding a handlebar 12*a* freely moves it in a horizontal direction and a vertical direction using an elastic force of spring members 30. Thus, the user can gain proper exercise effects by causing movements using an elastic force of the spring members 30 in a state of sitting on the exercise saddle 12.

Meanwhile, elastic connecting part may connect between the exercise saddle 12 and the post rod 20. Hereafter, the reference number of the elastic connecting part is the same as that of spring member 30.

A plurality of elastic connecting parts 30 may be installed in the front and the rear of the exercise saddle 12, respectively.

As the elastic connecting parts 30 are connected to the post rods 20 located at the front and the rear of the exercise saddle 12, respectively, the elastic connecting parts 30 may assist stable movements of the exercise saddle 12 while the exercise saddle 12 moves from front to back and side to side. The lengths of the elastic connecting parts 30 connected to the post rods 20 located at the front and the rear of the exercise saddle 12, respectively, are the same as or similar to each other.

Meanwhile, the bottom spring 40 may be installed at the bottom portion of the exercise saddle 12.

The bottom spring 40 may be installed to stably support weights in a state that a user sits on the exercise saddle 12, from the bottom portion of the exercise saddle 12.

As mentioned above, one embodiment of the bicycle exercise apparatus 100, the saddle can be installed to be moved by an elastic force of the spring members when a user pedals in a state of siting on the saddle.

Thus, in addition to a pedaling exercise effect, a user can obtain additional exercise effect according to movements of the exercise saddle 12 by an elastic force of the springs, which can improve user satisfaction.

Figure 5:
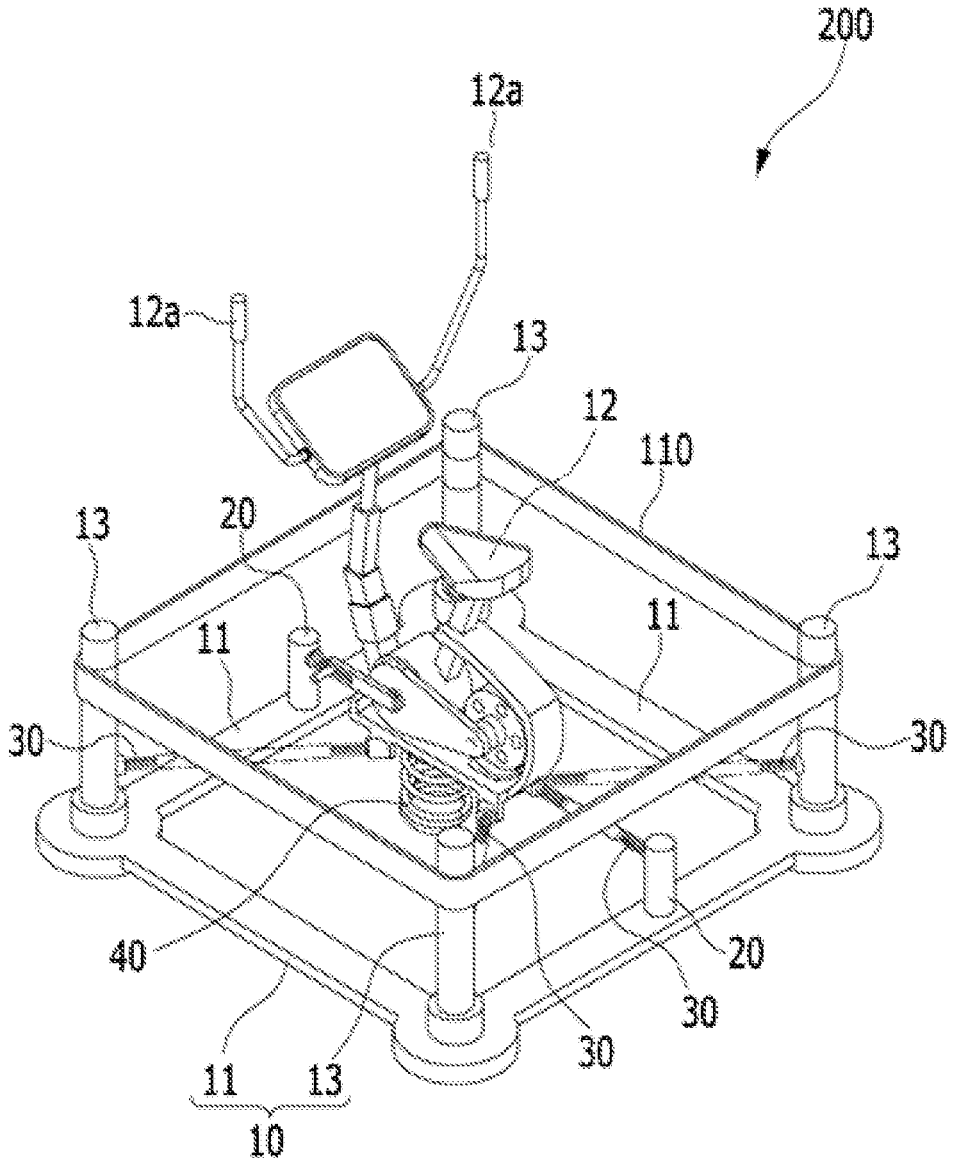
FIG. 5 schematically illustrates a perspective view of a bicycle exercise apparatus according to a second embodiment of the present invention.

FIG. 5 schematically illustrates a perspective view of a bicycle exercise apparatus according to a second embodiment of the present invention. The reference numbers in FIG. 5 which are the same as those in FIGS. 1 to 4 refer to the same or similar elements having the same or similar functions. Hereafter, a detailed description of the reference number mentioned above will be omitted.

As shown in FIG. 5, the bicycle exercise apparatus 200 according to the second embodiment of the present invention may comprise a guard member 110, which protects a user, between a plurality of the support frames 13.

The guard members 110 may be installed to connect between the support frames 13 in order to stably support the exercise saddle 12 when the exercise saddle 12 is inclined at an excessive angle.

The guard members 110 may be an elastic band having an elastic force, which connects between the support frames 13. Hereafter, the reference number of the elastic band will be the same as that of guard members 110.

The elastic band 110 may connect between the support frames 13 or may surround a plurality of the support frames 13 to connect each other.

Thus, as the exercise saddle 12 may not be excessively inclined to one side and prevents from safety accident during exercising, user satisfaction can be improved.

Figure 6:
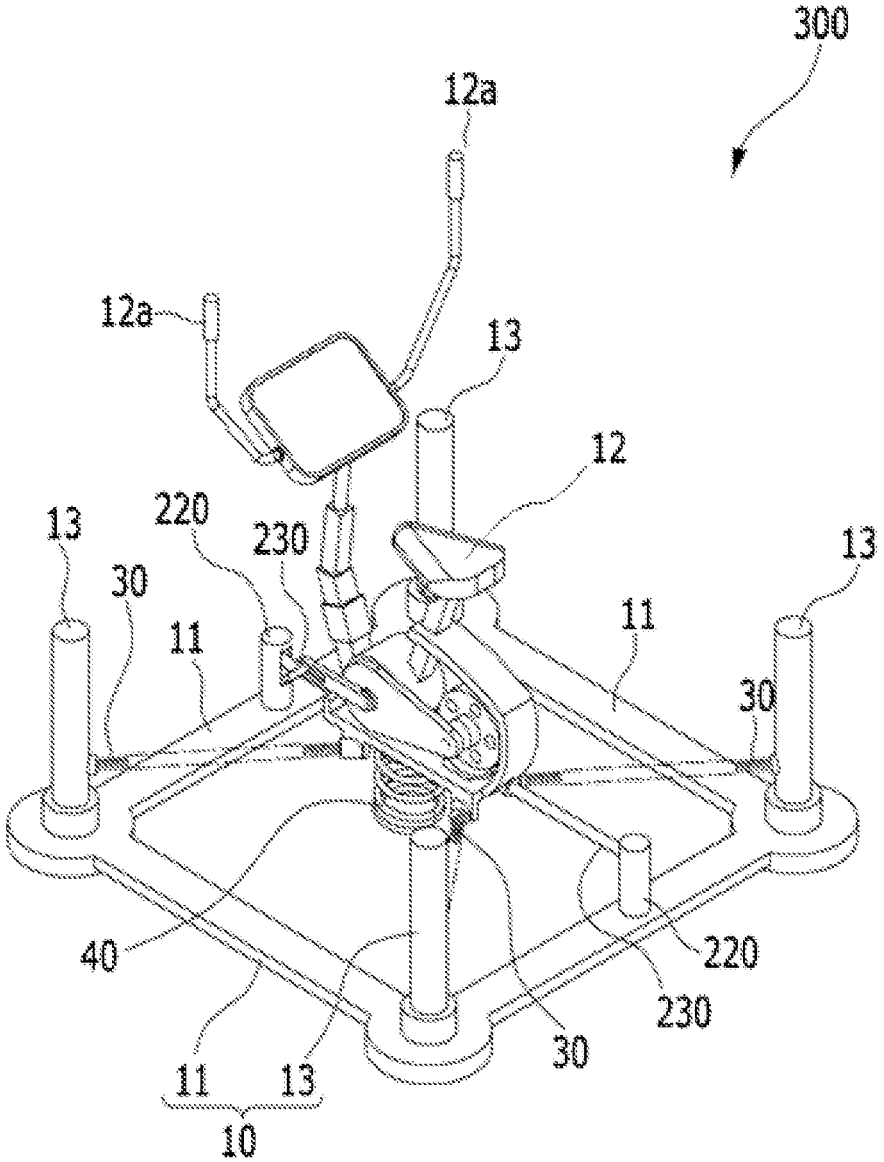
FIG. 6 schematically illustrates a perspective view of a bicycle exercise apparatus according to a third embodiment of the present invention.
Figure 7:
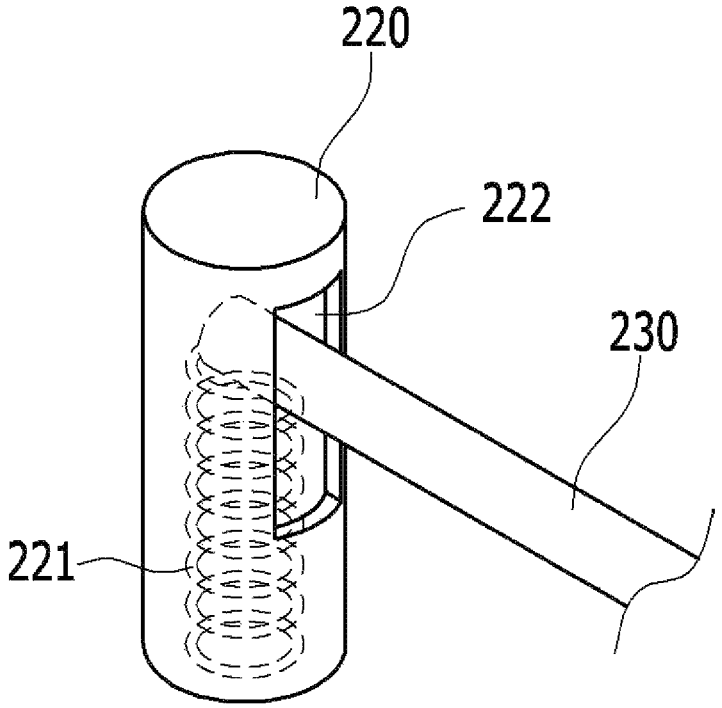
FIG. 7 schematically illustrates a magnified perspective view of a connection portion of a post rod and a connecting rod.

FIG. 6 schematically illustrates a perspective view of a bicycle exercise apparatus according to a third embodiment of the present invention. FIG. 7 schematically illustrates a magnified perspective view of a connection portion between a post rod and a connecting rod. The reference numbers in FIGS. 6 and 7 which are the same as those in FIGS. 1 to 5 refer to the same or similar elements having the same or similar functions. Hereafter, a detailed description of the reference number mentioned above will be omitted.

As shown in FIGS. 6 and 7, a post rid 220 of the bicycle exercise apparatus 300 according to the third embodiment of the present invention may be installed to receive a support spring 221 inside and comprise an opening 222 having a shape of a long hole at a lateral side. The support spring 221 is exposed through the opening 222.

One end of an elastic connecting part 230 may be connected to the exercise saddle 12, and the other end of the elastic connecting part may be a connecting rod. The other end of the elastic connecting part may be applied to the post rid 220 which is connected to the support spring 221 through the opening 222.

Thus, one end of the elastic connecting part 230 may be connected to the exercise saddle 12, and the other end may be connected to the support spring 221 through the opening 222 of the post rid 220. Accordingly, as the exercise saddle 12 is supported by an elastic force of the support spring 221, the support spring 221 supports stable movements of the exercise saddle 12.

While preferred embodiments of the present invention have been described, the present invention is not limited to what has been particularly shown. Many more modifications than mentioned above are possible within scopes of appended claims, specification, and drawings, and it would be apparent that the scope of the present invention includes these modifications and variations.

What is claimed is:

1. A bicycle exercise apparatus comprising:

a frame body installed to be supported by a floor of an installation site and having an exercise space in a center thereof, wherein the frame body comprises: a bottom frame supported by the floor, and a plurality of support frames protruded from the bottom frame;

a plurality of spring members each having a first end that is installed on the frame body and a second end that is extended to the exercise space, wherein each first end of the plurality of spring members is connected to a respective support frame of the plurality of support frames;

an exercise saddle comprising lateral sides wherein each second end of the plurality of spring members is connected to a respective lateral side of the exercise saddle in such a way that the exercise saddle is able to be moved by the elastic forces of the plurality of spring members;

a post rod protruded from the bottom frame between the support frames and connected to the exercise saddle through an elastic connecting part; and a support spring installed inside the post rod, wherein the post rod comprises an opening that has a shape of a long hole at a lateral side and exposes the support spring, and wherein a first end of the elastic connecting part is connected to the exercise saddle, and a second end of the elastic connecting part is a connecting rod which is connected to the support spring through the opening.

2. The bicycle exercise apparatus according to claim 1, the bicycle exercise apparatus further comprises a guard member that is installed between the support frames to protect a user.

3. The bicycle exercise apparatus according to claim 1, the bicycle exercise apparatus further comprises a bottom spring that is installed at a bottom portion of the exercise saddle.

* * * * *